US006666226B2

(12) United States Patent
Gill et al.

(10) Patent No.: US 6,666,226 B2
(45) Date of Patent: Dec. 23, 2003

(54) SERIES/PARALLEL RELIEF VALVE FOR USE WITH AIRCRAFT GASEOUS OXYGEN SYSTEM

(75) Inventors: Lawrence H. Gill, Grand Island, NY (US); Gary Thomasulo, Eden, NY (US); Glenn Maslowsky, West Falls, NY (US); William D. Siska, Jr., Elma, NY (US)

(73) Assignee: Carleton Technologies, Inc., Orchard Park, NY (US)

( * ) Notice: Subject to any disclaimer, the term of this patent is extended or adjusted under 35 U.S.C. 154(b) by 193 days.

(21) Appl. No.: 10/020,843

(22) Filed: Dec. 13, 2001

(65) Prior Publication Data

US 2003/0111112 A1 Jun. 19, 2003

(51) Int. Cl.[7] ..... F17D 1/04

(52) U.S. Cl. ..... 137/266; 137/255; 137/256; 137/613; 128/205.24

(58) Field of Search ..... 137/255, 256, 137/266, 613; 128/205.24

(56) References Cited

U.S. PATENT DOCUMENTS 4,148,311 A 4/1979 London et al.
4,499,914 A 2/1985 Schebler
4,856,507 A 8/1989 Ouillon et al.
4,960,119 A * 10/1990 Hamlin ..... 128/204.18
5,159,839 A 11/1992 Silber et al.
5,348,001 A 9/1994 Danon
5,460,175 A * 10/1995 Foote et al. ..... 128/205.24
5,542,447 A 8/1996 Foote et al.
5,832,885 A * 11/1998 Moyer ..... 123/90.16
6,070,610 A * 6/2000 Owler ..... 137/256 X
6,321,775 B1 * 11/2001 Hildebrand et al. ..... 137/266

* cited by examiner

*Primary Examiner*—Kevin Lee
(74) *Attorney, Agent, or Firm*—Jaeckle Fleischmann & Mugel, LLP

(57) ABSTRACT

A reliable and economical apparatus for relieving pressure in a large aircraft cabin oxygen supply, where multiple oxygen cylinders are used concurrently. A series-parallel array of valves actuated by changes in differential pressure between the oxygen supply and the ambient cabin atmosphere provides overpressure relief The series connection of the valves reduces the risk of open-valve failures, while the parallel connection of sets of series-connected valves reduces the risk of closed-valve failures. The small number of valves used in its design reduces the cost of the apparatus. The series-parallel structure is optionally extended to larger numbers of valves to facilitate the use of less-expensive valves and supporting components without loss of reliability.

18 Claims, 12 Drawing Sheets

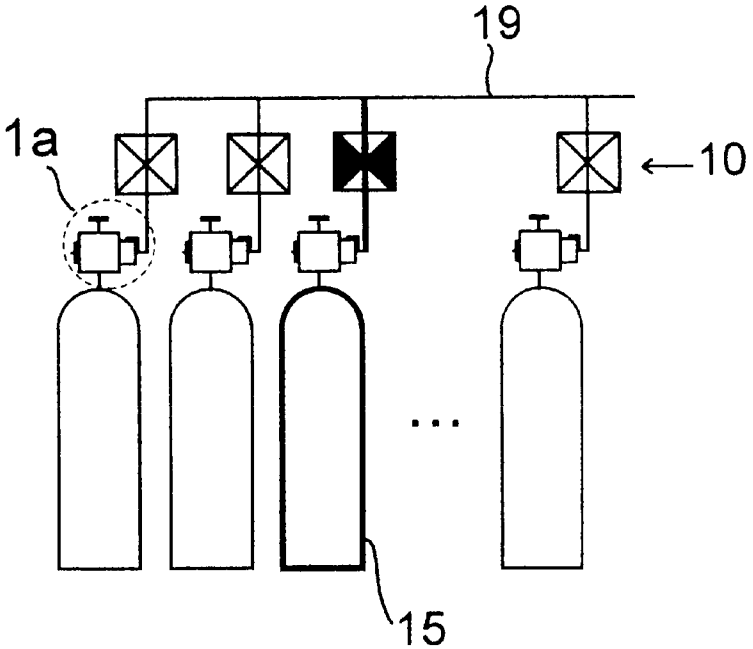
FIG. 1c (PRIOR ART)
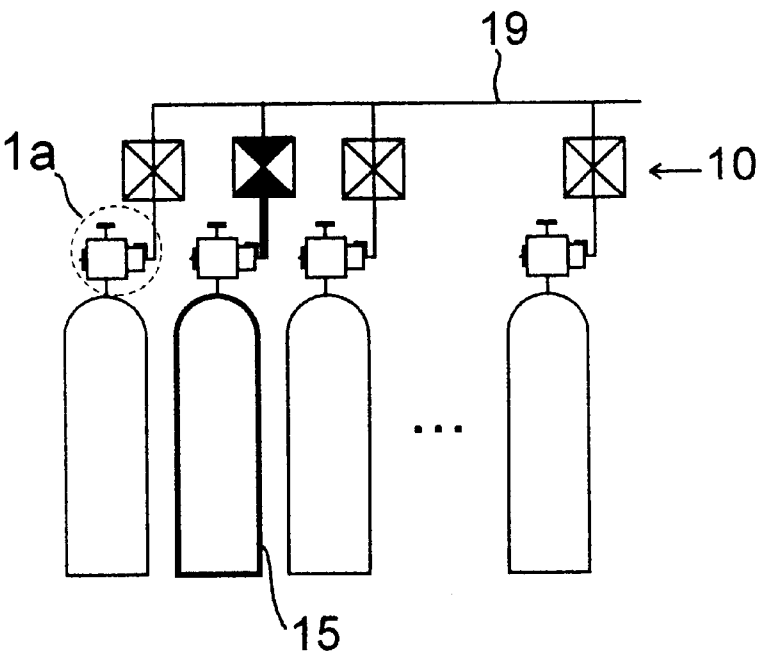
FIG. 1b (PRIOR ART)
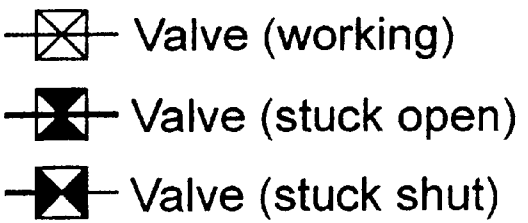

SERIES/PARALLEL RELIEF VALVE FOR USE WITH AIRCRAFT GASEOUS OXYGEN SYSTEM

FIELD OF INVENTION

This invention relates to systems for supplying breathable oxygen, and more specifically to relief valves for systems for supplying oxygen for breathing in an aircraft cabin.

DEFINITIONS

The term "poppet" is used here to refer to a single pressure-actuated valve mechanism

DISCUSSION OF PRIOR ART

An oxygen storage pressure relief system monitors a bank of oxygen cylinders, perhaps as many as twenty, which supply oxygen to the passenger and crew compartments of a medium size or large aircraft. The purpose of the relief system is to prevent an overpressure condition in both the lines from the oxygen cylinders and the manifold line, by opening the line under conditions of excess pressure and venting oxygen outside the aircraft cabin just until the overpressure condition is relieved. A buildup of pressure in the lines could break a line and flood the fuselage with pure oxygen causing a fire risk.

In conventional oxygen storage cylinder systems, such as that described in U.S. Pat. No. 5,159,839 (Silber et al.) there is a relief valve, made up of a single poppet valve, on each pressure reducer. See FIG. 1. Such prior art systems put a system relief valve 10 between the pressure regulator of each $O_2$ cylinder 15 and the relief manifold line 19, so that the single relief manifold line 19 carries oxygen for all cylinders 15. See FIG. 1*a* for detail. Each cylinder 15 has a DOT-required pressure relief burst disc 11 which is upstream of relief valve 10. Relief valve 10 is located at the outlet of a pressure regulator or reducer 12 which is mounted directly to the cylinder hand valve 14. If there are twenty cylinders 15, there are twenty relief valves 10.

See FIG. 1*b*, which shows a single operating case of the system of FIG. 1. This prior-art approach does not provide relief of overpressure when a valve 10 on a single cylinder 15 is stuck in a shut position, thereby preventing relief of overpressure in that cylinder. The stuck-shut case is a single-point failure case, in that the behavior of the system as a whole is degraded if only one failure occurs. The probability p of failure of a single relief valve may be very small, but in a prior-art system such as that in FIG. 1 with twenty oxygen cylinders all in active service, the probability of failure of any single valve is just under twenty times p. This approximate relationship is expressed in exact form as: $n\times(1-p)^{n-1}\times p$, where n is the number of valves and p is the probability of failure of a valve. For low individual-cylinder failure probabilities, the relationship holds in nearly linear fashion as the number of actively-serving oxygen cylinders increases.

A second failure mode of a relief valve occurs when it leaks or remains wide open, allowing the individual cylinders to bleed to zero psig. See FIG. 1*c*. When a valve 10 on a single cylinder 15 is stuck in an open position, it vents oxygen freely. Like the stuck-shut case, the stuck-open case is a single-point failure case, in that the behavior of the system as a whole is degraded if only one failure occurs.

This near-linear increase in the probability of a single-point failure makes larger prior-art systems more vulnerable to frequent valve failure and its system-wide consequences. A better-designed system would display reduced frequency of valve failure, and would restrict the consequences to the system whenever any such failure occurs.

Other prior-art systems, such as that described in U.S. Pat. No. 4,148,311 (London et al.) do not even address the problem of oxygen overpressure in a system with multiple oxygen cylinders as used in large aircraft. There is a clear need for an expandable, reliable, inexpensive oxygen pressure relief system for aircraft use.

SUMMARY

The invention is a reliable and economical apparatus for relieving pressure in a large aircraft cabin oxygen supply, where multiple oxygen cylinders are used concurrently. The invention uses a series-parallel array of valves actuated by changes in differential pressure between the oxygen supply and the ambient cabin atmosphere. The series connection of its valves reduces the risk of open-valve failures, while the parallel connection of sets of series-connected valves reduces the risk of closed-valve failures. The small number of valves used in its design reduces the cost of the invention. The invention's series-parallel structure is optionally extended to larger numbers of valves to facilitate the use of less-expensive valves and supporting components without loss of reliability.

DESCRIPTION OF DRAWINGS

FIG. 1*b* shows the prior-art system of FIG. 1 with an individual valve poppet in a stuck shut state.

FIG. 1*c* shows the prior-art system of FIG. 1 with an individual valve poppet in a stuck open state.

DETAILED DESCRIPTION OF INVENTION

Figure 1:
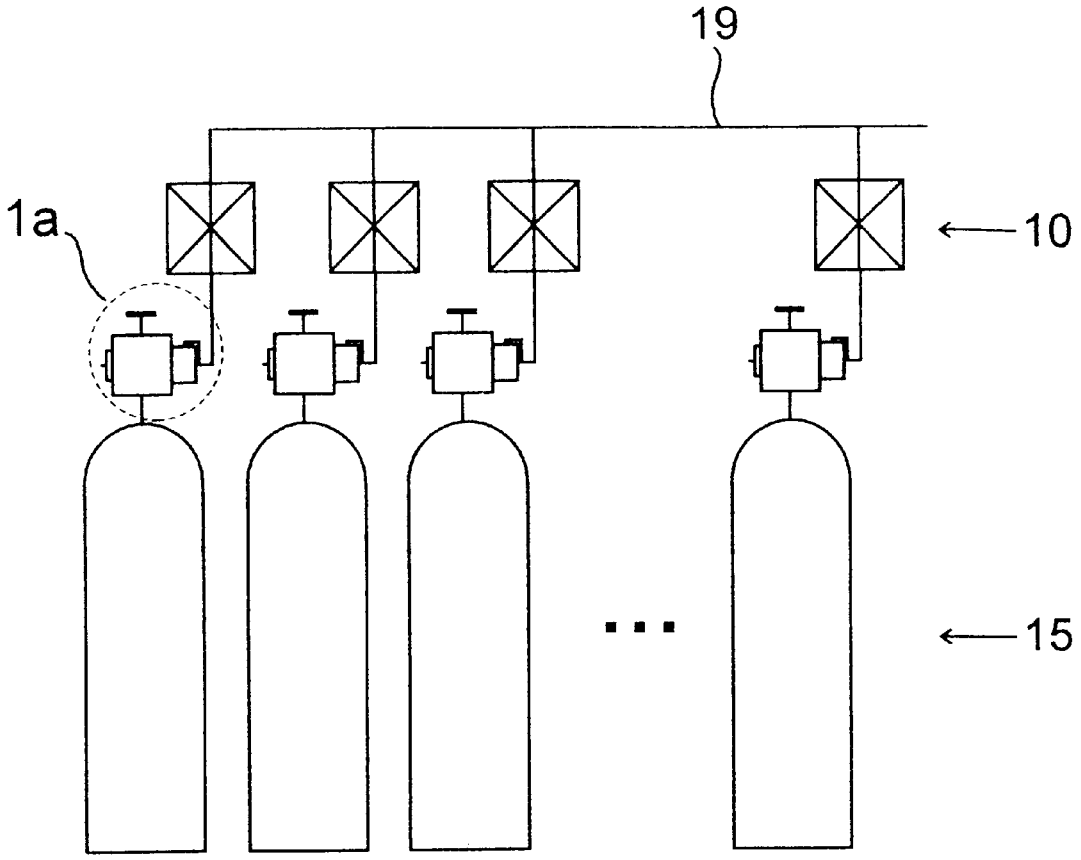
FIG. 1 (PRIOR ART)
FIG. 1 shows a typical prior-art oxygen supply system for the cabins of a large aircraft.
Figure 1A:
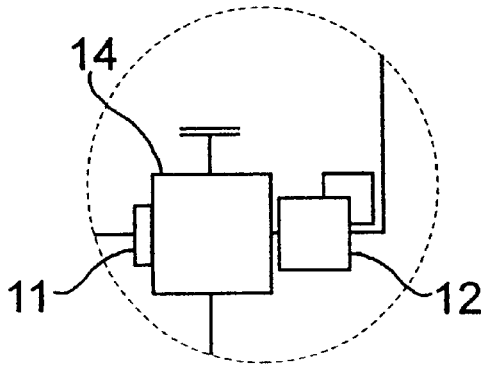
FIG. 1*a* shows an enlargement of the hand valve, burst disc, and pressure regulator of the prior-art system of FIG. 1.
Figure 2:
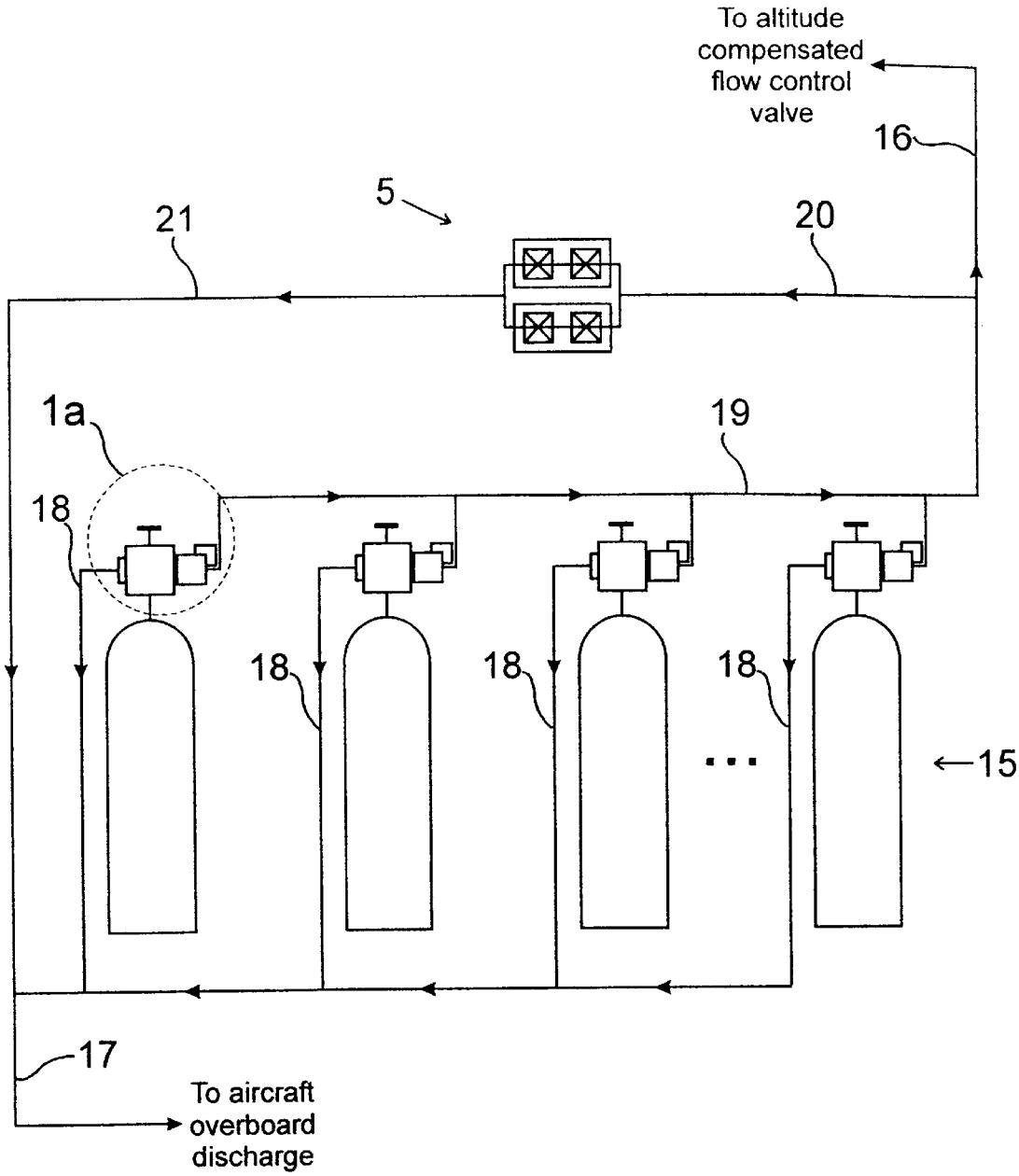
FIG. 2 shows the invention's oxygen supply system for the cabins of a large aircraft.

For an oxygen supply system incorporating the invention, see FIG. 2. Multiple $O_2$ cylinders 15 are connected to a common oxygen manifold line 19 to supply breathable oxygen via line 16 to aircraft passenger and crew compartments. Each cylinder provides oxygen through a valve mechanism, illustrated in detail in FIG. 1*a,* which includes an outlet line 18 for each safety burst disc. Outlet lines 18 connect to an aircraft overboard discharge line 17. The inlet line 20 of inventive relief valve 5 is connected to common oxygen manifold line 19 as shown, and the outlet line 21 of inventive relief valve 5 is connected to aircraft overboard discharge line 17. The direction of flow of $O_2$ in lines 17, 18, 19, 20 and 21 is shown by the arrows on each line.

Figure 3:
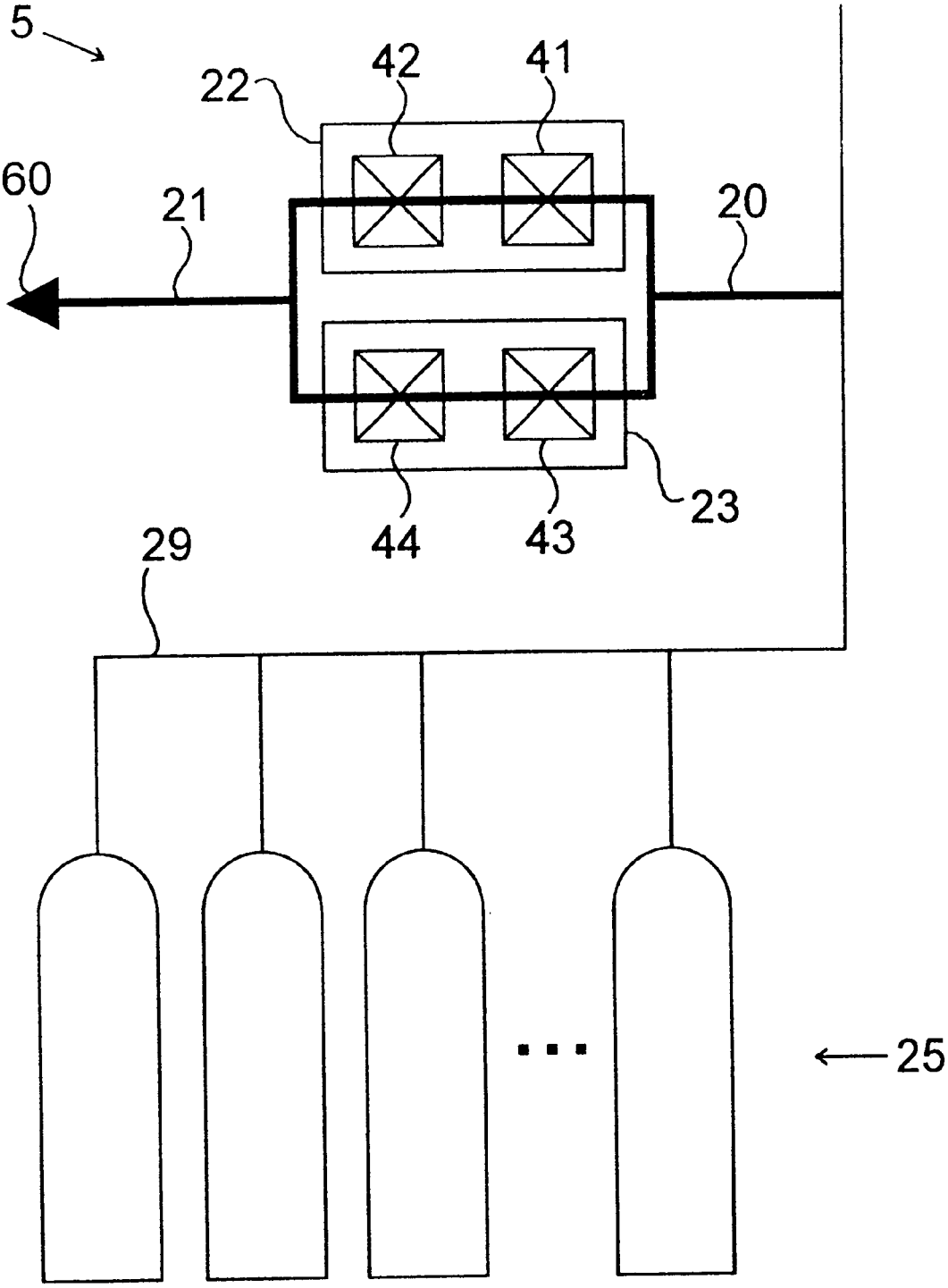
FIG. 3 shows the invention's relief valve in schematic form.

For simplicity of illustration, the hand valve, burst disc and regulator assemblies on each tank are omitted from the figures beginning with FIG. 3. As shown in FIG. 3, the invention allows the concurrent use of multiple oxygen cylinders or tanks while reducing the number of valves for the relief system to one valve with four internal poppets. In FIG. 3, multiple oxygen cylinders 25 are connected to a common oxygen manifold line 29. The invention 5 incorporates two internal sets 22, 23 of serial valve poppet pairs with each set in parallel with the other, forming the inventive valve. This arrangement keep the probability of failure of exactly one valve in this system at just under four times that of a single valve poppet, whether the number of oxygen cylinders is one, ten, or twenty. Arrow 60 shows the operational path for oxygen relief in this case.

Figure 3B:
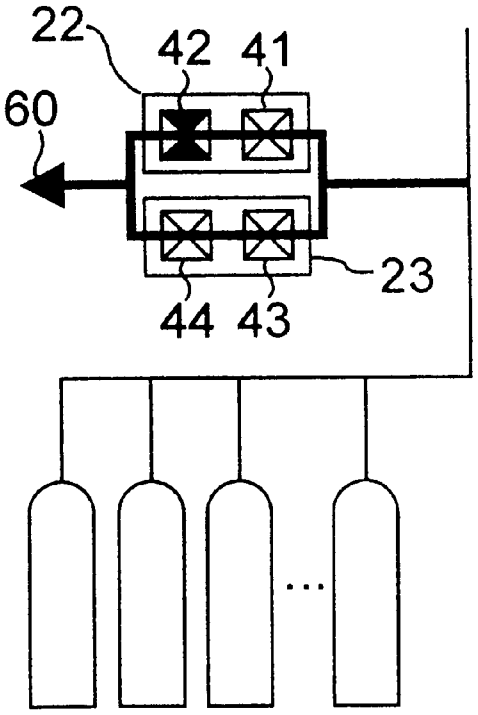
FIG. 3*b* shows the invention's system with an individual valve poppet in a stuck open state.
Figure 3A:
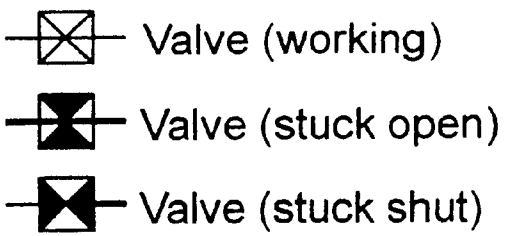
FIG. 3*a* shows the invention's system with an individual valve poppet in a stuck shut state.
Figure 3A:
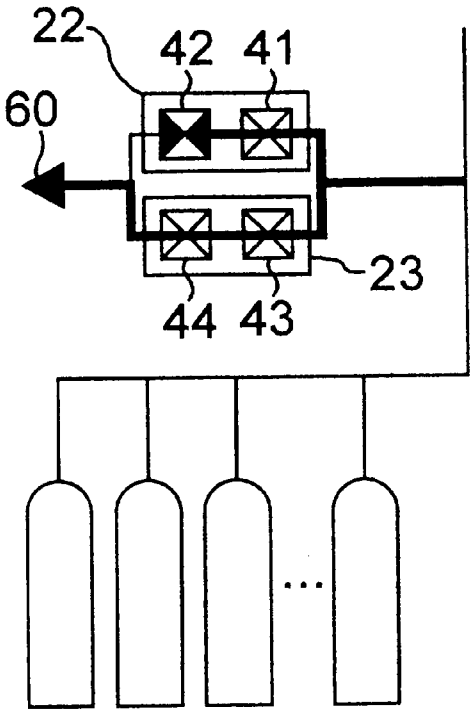

FIG. 3*a* shows the failure case where a single valve poppet 42 in a serial pair 22 has failed in the closed position. In this case, its companion series valve poppet 41 can open, but oxygen cannot pass through the stuck-shut valve poppet 42. The opposite pair 23 of valve poppets 43, 44 then operate to provide pressure relief as needed. The system will therefore operate normally, even with a failed valve poppet in the closed position. Arrow 60 shows the operational path for oxygen relief in this case.

FIG. 3*b* shows the failure case where a single valve poppet 42 has failed in the open position. In this case, its companion series valve poppet 41 can still operate correctly, and the system will operate normally through both valve poppet pairs, even with a failed valve poppet in the open position. Arrow 60 shows the operational path for oxygen relief in this case.

Given four valve poppets in all, and an overall probability p of a valve poppet failing, the probability of exactly one of the four valves failing is $4\times(1-p)^3\times p$. For a system with twenty oxygen cylinders, this represents a fivefold reduction in failure probability with respect to the prior-art example, with the added advantage of continued acceptable system operation during the single-poppet failure.

Dual-valve failure in the prior-art system simply exacerbates the system degradation or failure. A dual-valve failure in the invention, however, still permits normal system operation in many cases. Refer to FIGS. 4*a*–4*d.* Two stuck-shut valve poppets 41,42 in the same serial valve poppet pair 22 (FIG. 4*a*) do not affect the operation of the two remaining valve poppets 43, 44 in the second serial valve poppet pair 23. Likewise, a stuck-open valve poppet 42 and a stuck-shut valve poppet 41 in the same serial valve poppet pair 22 (FIG. 4*b*) do not affect the operation of the two remaining valve poppets 43, 44 in the second serial valve poppet pair 23. Two stuck-open valve poppets 42, 43 in opposite serial pairs 22, 23 (FIG. 4*c*) still permit the remaining valve poppets 41, 44 in each serial pair to operate correctly. In each figure, arrow 60 shows the operational path for oxygen pressure relief.

Figure 4B:
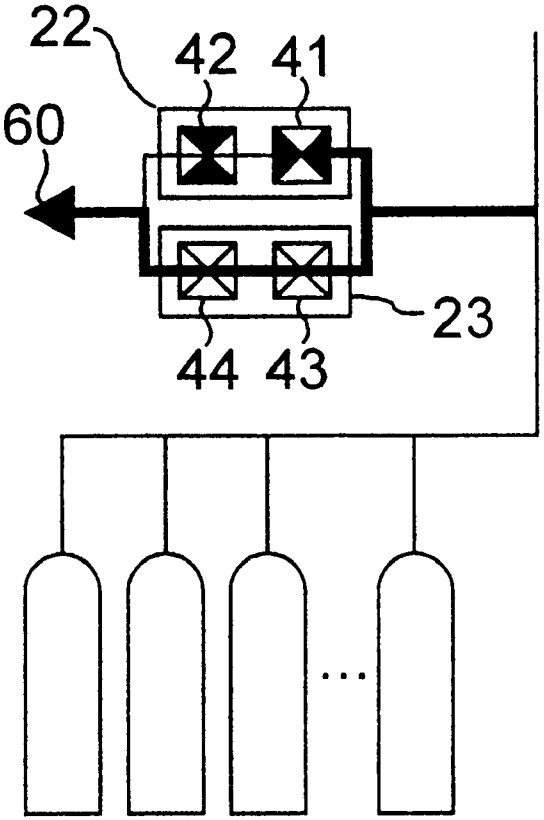
FIG. 4*b* shows the invention's system with one valve poppet in a stuck shut state and the second valve poppet in the same serial pair in a stuck open state.
Figure 4A:
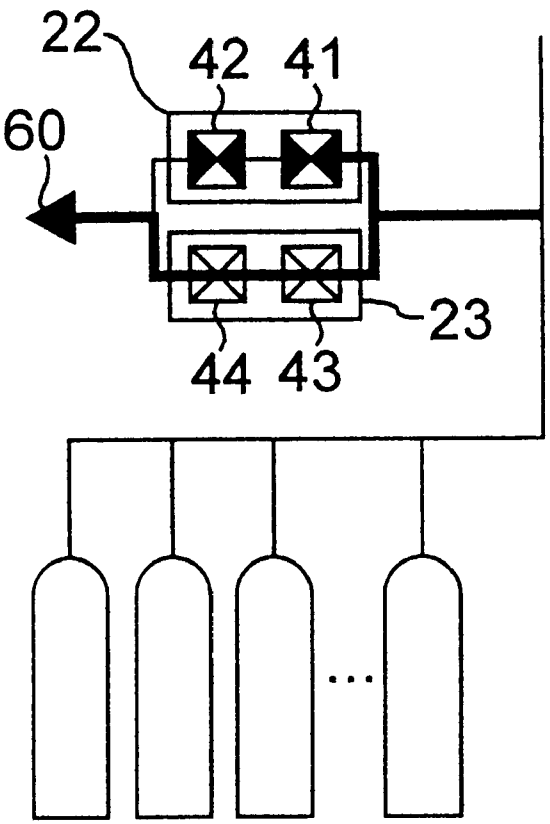
FIG. 4*a* shows the invention's system with two valve poppets in the same serial valve pair in a stuck shut state.
Figure 4D:
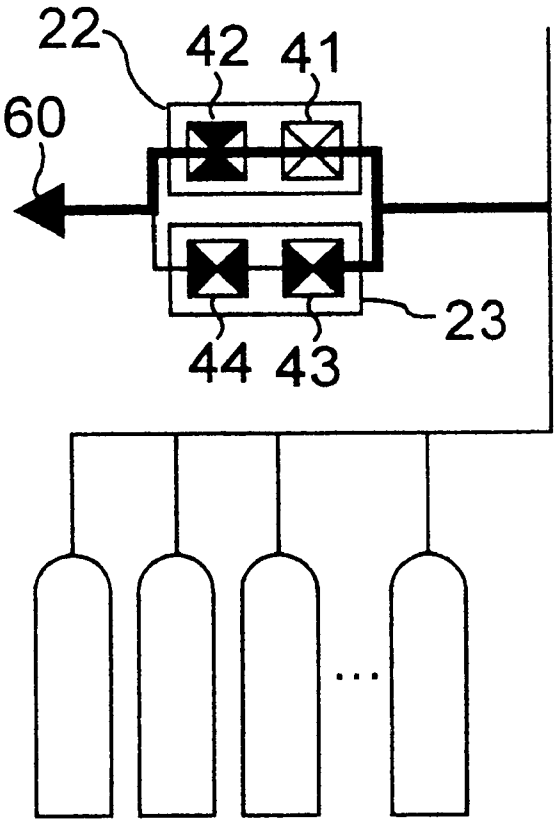
FIG. 4*d* shows the invention's system with two valve poppets in the same serial pair in a stuck shut state, and a valve poppet in the opposite serial pair in a stuck open state.
Figure 4C:
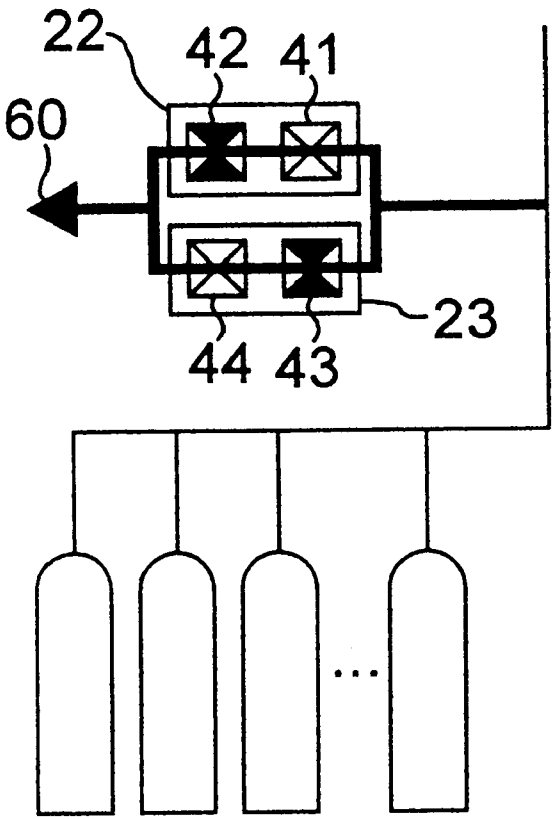
FIG. 4*c* shows the invention's system with two valves in opposite serial valve pairs in a stuck open state.

The invention sustains proper system operation even in certain triple-failure cases. In one of these cases, both valve poppets 43, 44 in a serial pair 23 are stuck shut, and one valve poppet 42 in the opposite pair 22 is stuck open (FIG. 4*d*). Arrow 60 shows the operational path for oxygen relief In another case (not shown), the case of FIG. 4*b* combines with a stuck-open valve poppet in the opposite serial pair, which leaves one operational valve poppet still permitting the system to operate correctly. Finally, in a last case (not shown), the case of FIG. 4*c* combines with a third stuck-open valve poppet in either of the serial pairs, which as in the previous case leaves one operational valve poppet still permitting the system to operate correctly.

Figure 5:
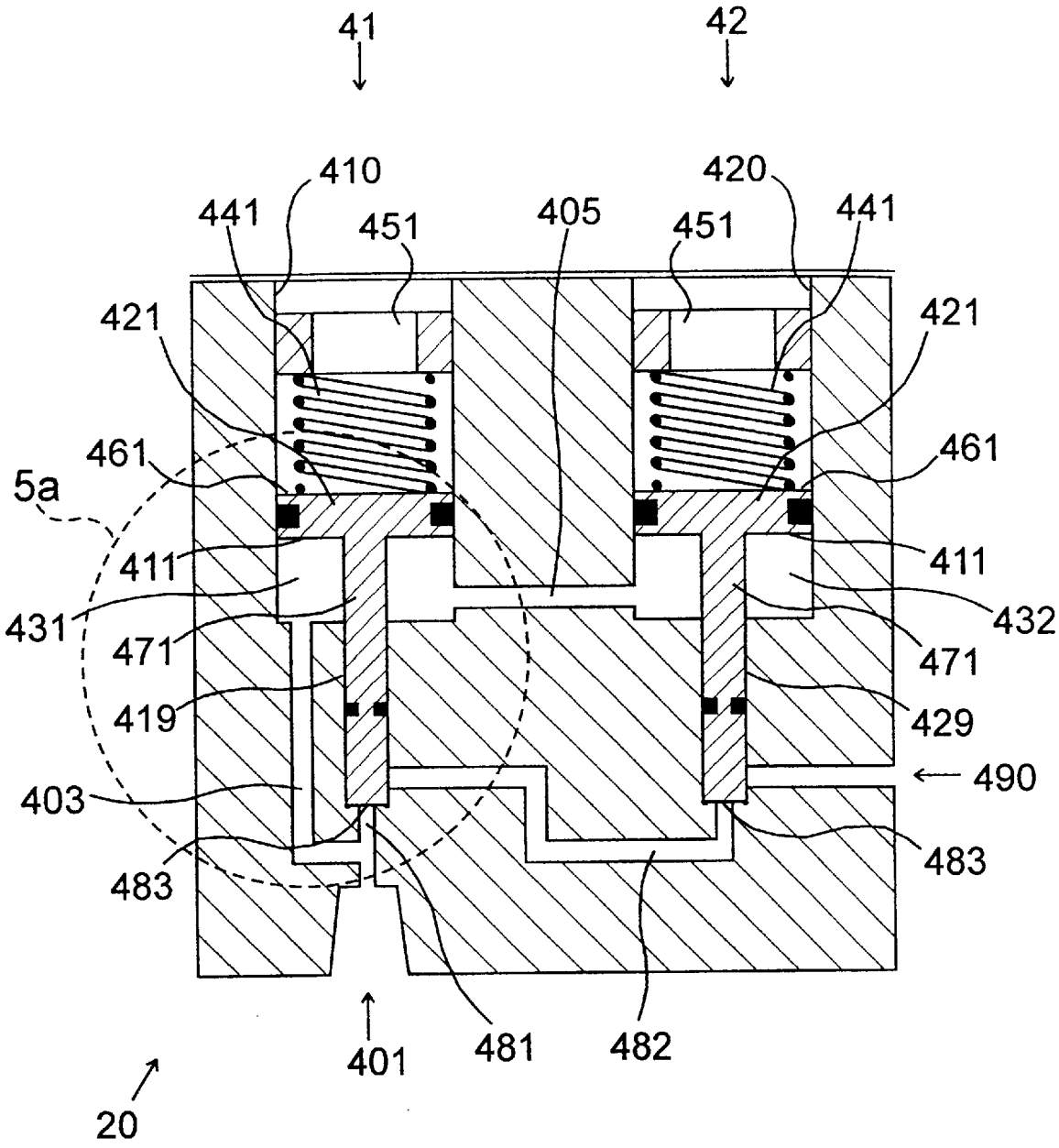
FIG. 5 shows a cross section of the invention's series pair of valve poppets.

The invention's serial pair of individual relief valve poppets 20 is shown in FIG. 5. Each set of individual relief valve poppets 20 includes two individual relief valve poppets 41, 42, each containing a piston cylinder 410, 420 respectively. In each piston cylinder is a piston 421. An oxygen cylinder manifold line is connected to the series valve poppet pair at inlet opening 401. Inlet opening 401 connects to control passage 403, which in turn connects freely to chamber 431 of individual relief valve poppet 41 as shown. Chamber 431 connects freely to control passage 405, which in turn connects freely to chamber 432 of individual relief valve poppet 42 as shown. Pistons 421 separate chambers 431, 432 from chambers 451 in cylinders 410, 420 respectively as shown. Helical compression springs 441 seated in chambers 451 apply pressure against faces 461 of pistons 421. Rods 471 extend from pistons 421 into extension cylinders 419, 429 to block relief valve outlet openings 483 of relief passages 481, 482 respectively as shown, when pistons 421 are fully displaced downward away from chambers 451.

Figure 5A:
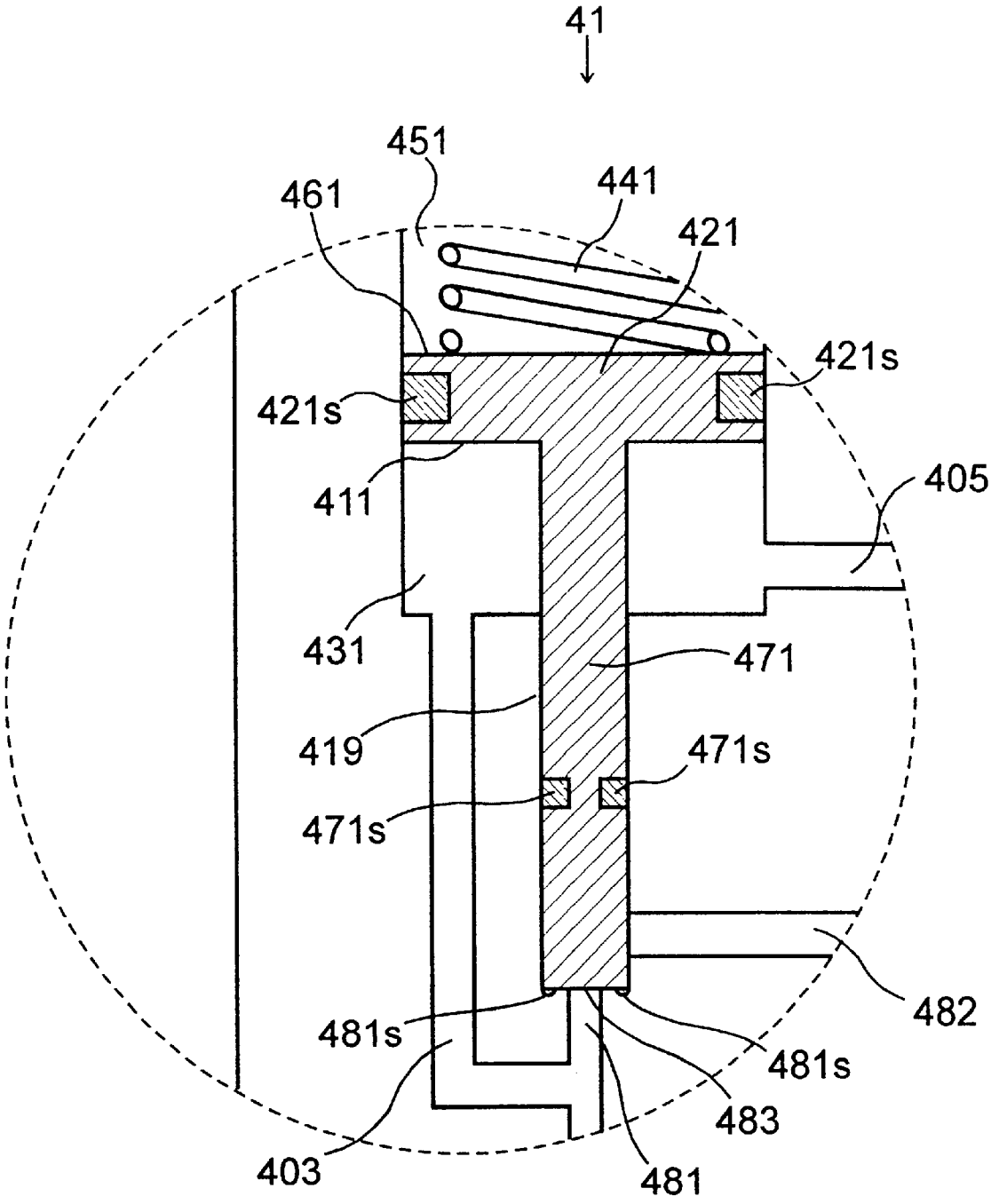
FIG. 5*a* shows an enlarged cross section of one of the invention's serial pair of valve poppets.

Refer to FIG. 5*a,* showing an enlargement of part of valve poppet 41 in order to identify valve poppet seals. To prevent escape of oxygen from chamber 431 to chamber 451 and the ambient air, annular seal 421*s* is disposed around piston 421. To prevent escape of oxygen from chamber 431 to relief passage 482, annular seal 471*s* is disposed around rod 471. To prevent escape of oxygen from passage 481 to passage 482 and the oxygen outlet passage via valve poppet 42, annular seal 481*s* is disposed around the end of extension cylinder 419. The seals of valve poppet 42 are disposed similarly. To increase the reliability of each valve poppet, double seals may be used where single seals are illustrated.

For the operation of both valve poppets in the series, see FIG. 5. Via control passages 403, 405 to both individual relief valve poppets 41, 42 of the series, the oxygen from inlet 401 builds up pressure against faces 411 of pistons 421 in piston cylinders 410, 420 respectively. The oxygen pressure is opposed both by the force of springs 441 and the pressure of ambient air in piston cylinders 410, 420 on the opposite faces 461 of pistons 421. For an oxygen pressure exceeding the opposing pressure by a predetermined amount, pistons 421 rise enough to draw rods 471 upward to open passages 481, 482 and let excess oxygen discharge via outlet passage 490. In the case that either of valve poppets 41, 42 valve fails in an open state, the series arrangement of the valve poppets keeps the system working properly. Annular valve seals, shown in black in FIG. 5 and detailed in FIG. 5*a,* prevent oxygen and air leakage in the valve poppets. The oxygen discharged via outlet passage 490 vents to the exterior of the aircraft via an overboard discharge line.

Figure 6:
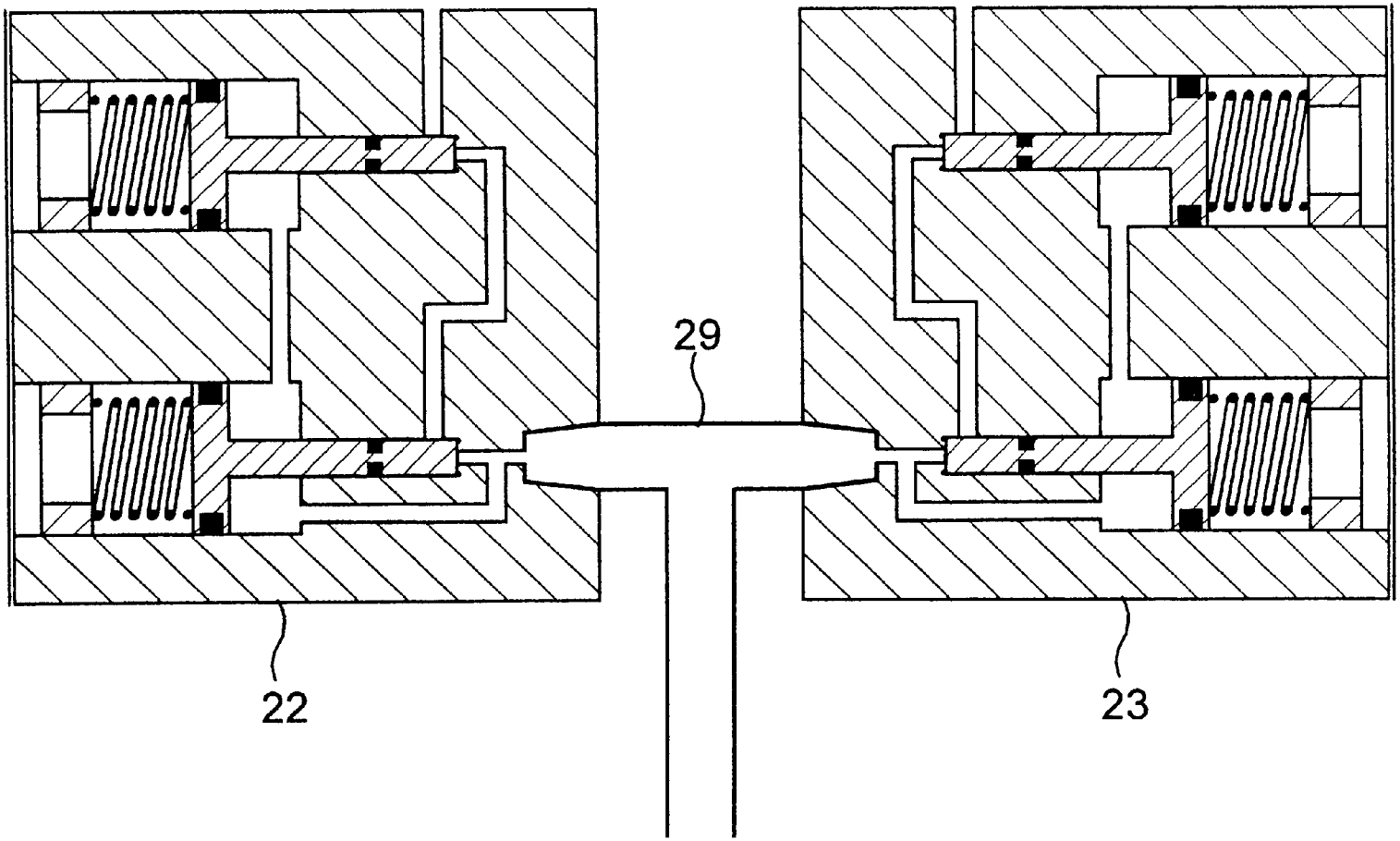
FIG. 6 shows the parallel connection of a pair of the serial pairs of poppets of FIG. 5.

As shown in FIG. 6, the invention connects two of these valve poppet pairs 22, 23 in parallel with each other to oxygen manifold supply line 29. As discussed earlier, this arrangement still protects against a valve poppet failing open, and further protects against a valve poppet failing closed. If a valve poppet fails closed, that set of pistons is useless, but with the other set of pistons in parallel, the system will still work correctly.

Figure 7:
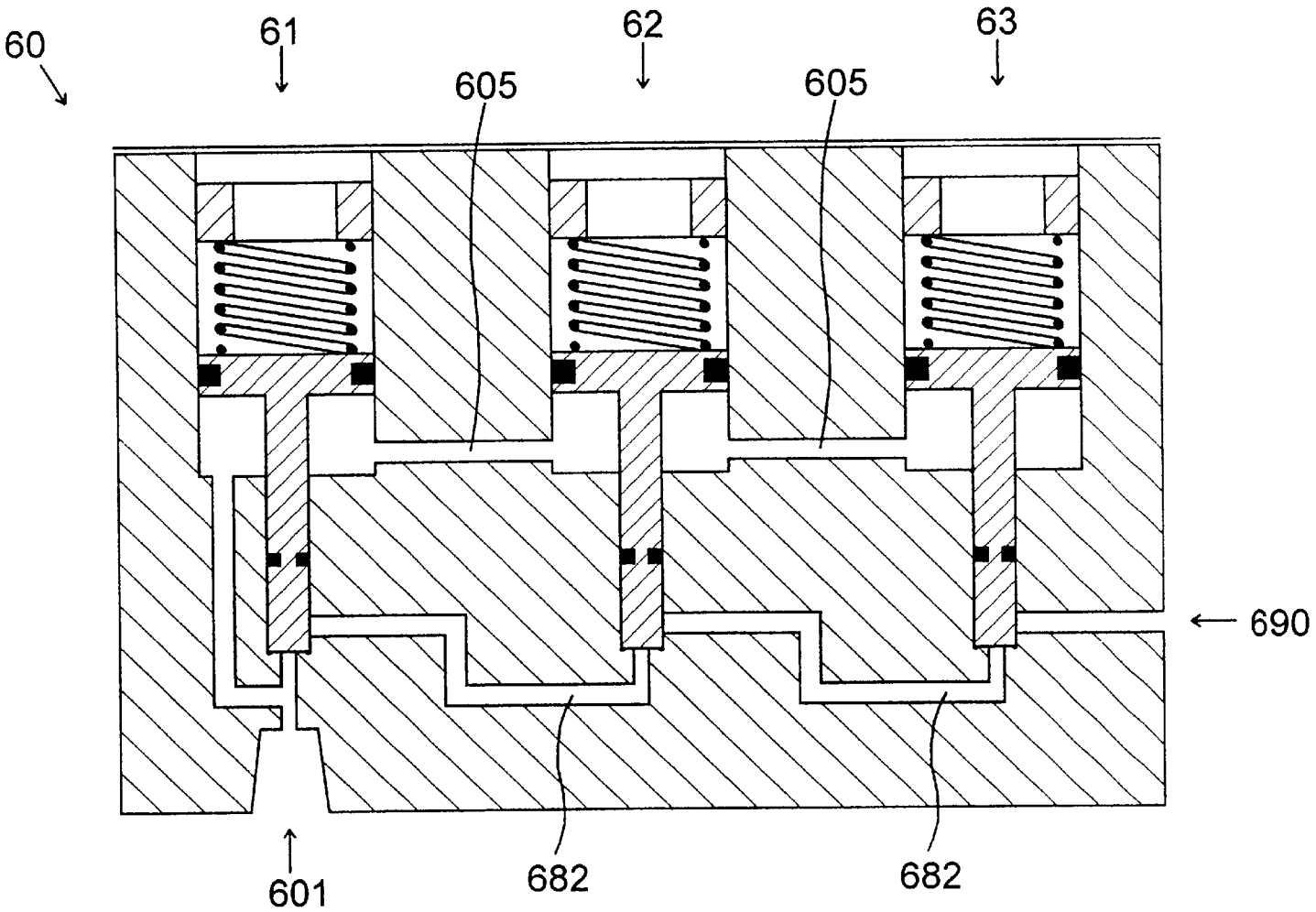
FIG. 7 shows a cross section of the invention's series of valve poppets, in an alternate embodiment.
Figure 7A:
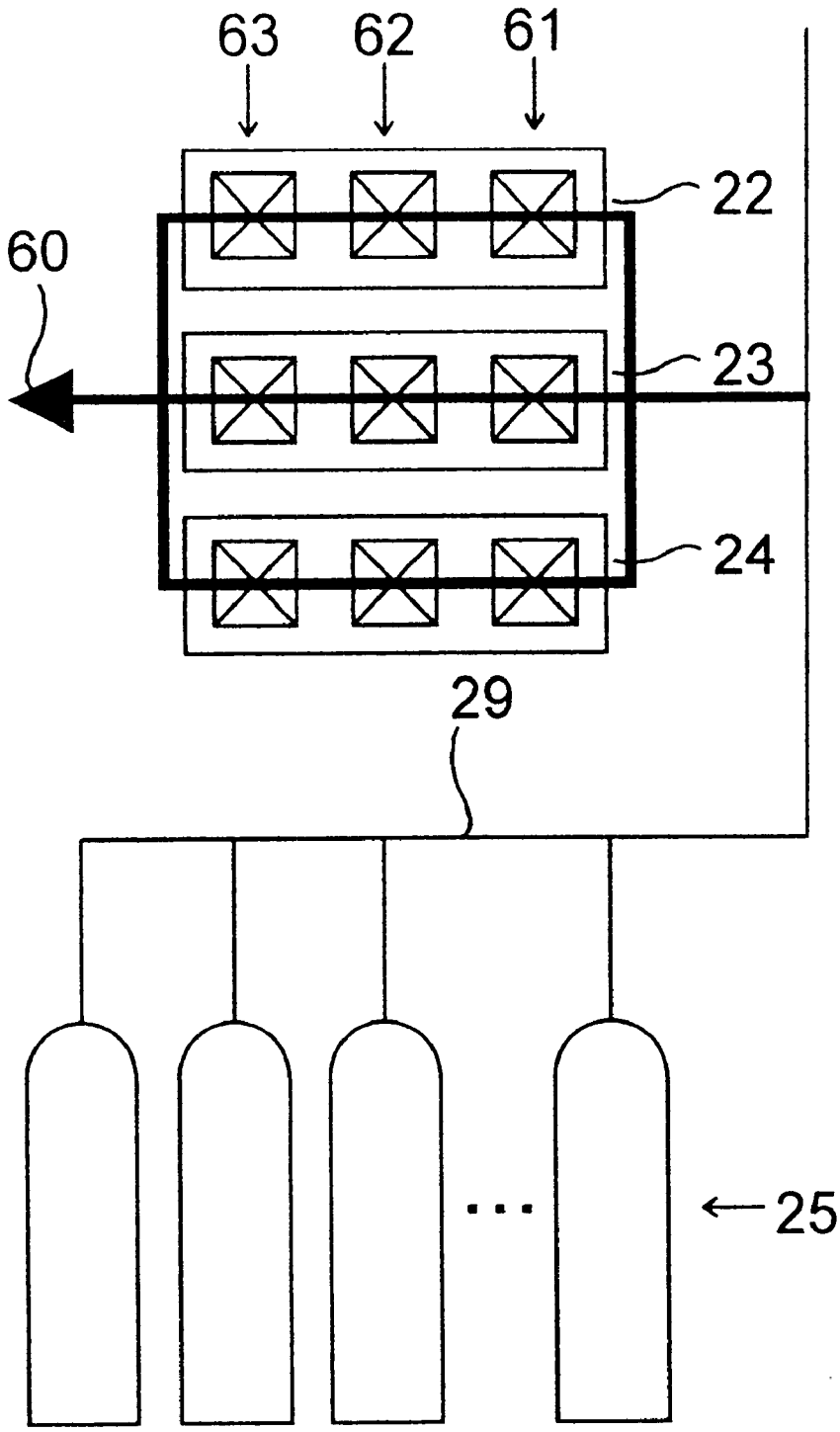
FIG. 7*a* shows the alternate embodiment's oxygen supply system in schematic form.

Alternative embodiments of the invention extend its series-parallel structure to incorporate three or more valve poppets in series, and three or more sets of series valve poppets in parallel. See FIG. 7. The extension to additional individual valve poppets in series is illustrated with three individual valve poppets 61, 62, 63 with interconnecting passages 605 and 682. The extension to additional parallel sets of such series valve poppets is exemplified in FIG. 7*a,* where three sets 22, 23, 24 each with series valve poppets 61, 62, 63 are connected to provide a complete relief valve system. Such an extension is particularly advantageous when a reliable relief valve system is constructed of lower-cost components with possibly-higher individual expected failure rates. Increasing the number of valve poppets in each series improves the system's overall reliability with respect to stuck-open valve poppet failures, and increasing the number of sets of series valve poppet sets in parallel improves the system's overall reliability with respect to stuck-shut valve poppet failures.

In summary, the invention's series/parallel valve poppet arrangement allows oxygen storage cylinder systems with multiple cylinders to be designed so that there is only one system of relief valve poppets with a number of relief valve poppets well below the number of cylinders in use. The invention's design enables proper oxygen relief system operation under all conditions of single-valve-poppet failure, and under many conditions of multiple-valve-poppet failure, making the system highly reliable at low cost.

Conclusion, Ramifications, and Scope of Invention

From the above descriptions, figures and narratives, the invention's advantages in providing reliable, inexpensive oxygen overpressure relief in an aircraft oxygen supply system should be clear.

Although the description, operation and illustrative material above contain many specificities, these specificities should not be construed as limiting the scope of the invention but as merely providing illustrations and examples of some of the preferred embodiments of this invention.

Thus the scope of the invention should be determined by the appended claims and their legal equivalents, rather than by the examples given above.

What is claimed is:

1. An apparatus for relieving pressure in an aircraft cabin oxygen supply, having reduced risk of open valve failures and closed valve failures, comprising:

an oxygen manifold line connected to a plurality of oxygen cylinders;

two or more sets of relief valve poppets, wherein each set comprises two or more individual relief valve poppets connected in series with each other, and wherein said sets are connected in parallel with each other to the oxygen manifold line.

2. The apparatus of claim 1, wherein each set of connected individual relief valve poppets comprises:

an inlet opening for oxygen, for connection to an oxygen manifold line;

one or more control passages connected to the inlet opening, for opening and closing the set of connected individual relief valve poppets;

two or more individual relief valve poppets connected in series with each other, each connected at one end to the control passage and open at the other end to an ambient atmosphere;

a first relief passage from the inlet opening to a first individual relief valve poppet;

a second relief passage between each serially connected pair of individual relief valve poppets;

a third relief passage from the last individual relief valve poppet to an outlet, for relieving oxygen pressure.

3. The apparatus of claim 2, wherein each individual relief valve poppet further comprises:

a piston cylinder, connected at one end to the control passage and open at the other end to an ambient atmosphere;

a slidable piston within the piston cylinder, having an annular seal between the piston and the piston cylinder wall, and separating the control passage from the ambient atmosphere;

a helical compression spring within the piston cylinder, its axis parallel to the axis of said piston cylinder, having one end attached to the slidable piston and the other end attached to the end of the piston cylinder open to the ambient atmosphere;

an extension cylinder open to and abutting the piston cylinder, its axis parallel to the axis of said piston cylinder, connected to the control passage and having a control end open at the end of said piston cylinder, and a valve end at its other end;

a relief valve inlet, at one end open to and abutting the valve end of the extension cylinder and connected to a relief passage;

a relief valve outlet open at one end to the side of the valve end of the extension cylinder and connected to a relief passage;

a rod within the extension cylinder, connected at one end to the piston within the piston cylinder, for opening the relief valve inlet into the relief valve outlet when and only when the pressure of the inlet oxygen exceeds the combined pressure of the ambient atmosphere and the spring force sufficiently to displace the rod from the end of the extension cylinder and expose the relief valve outlet opening.

4. The apparatus of claim 3 wherein an annular seal is disposed between the rod and the extension cylinder wall, separating the control passage from the relief passage.

5. The apparatus of claim 3 wherein an annular seal is disposed between the rod and the relief valve inlet.

6. The apparatus of claim 1, wherein each set of connected individual relief valve poppets comprises:

an inlet opening for oxygen, for connection to an oxygen manifold line;

a control means for opening and closing the set of connected individual relief valve poppets;

two or more individual relief valve poppets, each operated by the control means;

a first relief passage from the inlet opening to a first individual relief valve poppet;

a second relief passage between each serially connected pair of individual relief valve poppets;

a third relief passage from the last individual relief valve poppet to a discharge opening, for relieving oxygen pressure.

7. The apparatus of claim 6, wherein the control means further comprises:

a piston cylinder, connected at one end to the control passage and open at the other end to an ambient atmosphere;

a slidable piston within the piston cylinder, having an annular seal between the piston and the piston cylinder wall, and separating the control passage from the ambient atmosphere;

a compression means within the piston cylinder, for applying pressure against oxygen in the control passage;

a valve means controlled by the piston within the piston cylinder, for permitting passage of oxygen when and only when the pressure of the inlet oxygen exceeds the combined pressure of the ambient atmosphere and the compression means sufficiently to open the valve means.

8. The apparatus of claim 7, wherein the compression means further comprises a helical compression spring, its axis parallel to the axis of said piston cylinder, having one end attached to the slidable piston and the other end attached to the end of the piston cylinder open to the ambient atmosphere.

9. The apparatus of claim 7, wherein the valve means further comprises:

a valve poppet controlled by the control means, for stopping or starting the flow of oxygen;

a relief valve inlet connected to a first relief passage and to said valve poppet, for letting oxygen enter said valve;

a relief valve outlet connected to a second relief passage and to said valve poppet, for letting oxygen exit said valve poppet when said valve poppet is open.

10. An apparatus for relieving pressure in an aircraft cabin oxygen supply, having reduced risk of open valve failures and closed valve failures, comprising:

an oxygen manifold line connected to a plurality of oxygen cylinders;

first and second sets of relief valves, wherein each set comprises two or more individual relief valve poppets connected in series with each other, and said sets are connected in parallel with each other to the oxygen manifold line.

11. The apparatus of claim 10, wherein each set of connected individual relief valve poppets comprises:

an inlet opening for oxygen, for connection to an oxygen manifold line;

one or more control passages connected to the inlet opening, for opening and closing the set of connected individual relief valve poppets;

two individual relief valve poppets connected in series with each other, each connected at one end to the control passage and open at the other end to an ambient atmosphere;

a first relief passage from the inlet opening to a first individual relief valve poppet;

a second relief passage between the serially connected pair of individual relief valve poppets;

a third relief passage from the second individual relief valve poppet to an outlet, for relieving oxygen pressure.

12. The apparatus of claim 11, wherein each individual relief valve poppet further comprises:

a piston cylinder, connected at one end to the control passage and open at the other end to an ambient atmosphere;

a slidable piston within the piston cylinder, having an annular seal between the piston and the piston cylinder wall, and separating the control passage from the ambient atmosphere;

a helical compression spring within the piston cylinder, its axis parallel to the axis of said piston cylinder, having one end attached to the slidable piston and the other end attached to the end of the piston cylinder open to the ambient atmosphere;

an extension cylinder open to and abutting the piston cylinder, its axis parallel to the axis of said piston cylinder, connected to the control passage and having a control end open at the end of said piston cylinder, and a valve end at its other end;

a relief valve inlet, at one end open to and abutting the valve end of the extension cylinder and connected to a relief passage;

a relief valve outlet open at one end to the side of the valve end of the extension cylinder and connected to a relief passage;

a rod within the extension cylinder, connected at one end to the piston within the piston cylinder, for opening the relief valve inlet into the relief valve outlet when and only when the pressure of the inlet oxygen exceeds the combined pressure of the ambient atmosphere and the spring force sufficiently to displace the rod from the end of the extension cylinder and expose the relief valve outlet opening.

13. The apparatus of claim 12 wherein an annular seal is disposed between the rod and the extension cylinder wall, separating the control passage from the relief passage.

14. The apparatus of claim 12 wherein an annular seal is disposed between the rod and the relief valve inlet.

15. The apparatus of claim 10, wherein each set of connected individual relief valve poppets comprises:

an inlet opening for oxygen, for connection to an oxygen manifold line;

a control means for opening and closing the set of connected individual relief valve poppets;

two or more individual relief valve poppets, each operated by the control means;

a first relief passage from the inlet opening to a first individual relief valve poppet;

a second relief passage between each serially connected pair of individual relief valve poppets;

a third relief passage from the last individual relief valve poppet to a discharge opening, for relieving oxygen pressure.

16. The apparatus of claim 15, wherein the control means further comprises:

a piston cylinder, connected at one end to the control passage and open at the other end to an ambient atmosphere;

a slidable piston within the piston cylinder, having an annular seal between the piston and the piston cylinder wall, and separating the control passage from the ambient atmosphere;

a compression means within the piston cylinder, for applying pressure against oxygen in the control passage;

a valve means controlled by the piston within the piston cylinder, for permitting passage of oxygen when and only when the pressure of the inlet oxygen exceeds the combined pressure of the ambient atmosphere and the compression means sufficiently to open the valve means.

17. The apparatus of claim 16, wherein the compression means further comprises a helical compression spring, its axis parallel to the axis of said piston cylinder, having one end attached to the slidable piston and the other end attached to the end of the piston cylinder open to the ambient atmosphere.

18. The apparatus of claim 16, wherein the valve means further comprises:

a valve poppet controlled by the control means, for stopping or starting the flow of oxygen;

a relief valve inlet connected to a first relief passage and to said valve poppet, for letting oxygen enter;

a relief valve outlet connected to a second relief passage and to said valve poppet, for letting oxygen exit said valve poppet when said valve is open.

* * * * *